US006271804B1

(12) United States Patent
Yanagisawa et al.

(10) Patent No.: US 6,271,804 B1
(45) Date of Patent: Aug. 7, 2001

(54) ANTENNA FOR MOUNTING ON VEHICLE, ANTENNA ELEMENT AND MANUFACTURING METHOD THEREOF

(75) Inventors: Wasuke Yanagisawa, Machida; Ryo Horie, Saitama; Shozaburo Kameda, Yokohama; Takao Kawahara, Ayase; Tomio Anbe, Tomioka; Katsuo Miki, Gumma, all of (JP)

(73) Assignee: Yokowo Co., Ltd., Tokyo (JP)

( * ) Notice: Subject to any disclaimer, the term of this patent is extended or adjusted under 35 U.S.C. 154(b) by 0 days.

(21) Appl. No.: 09/476,796

(22) Filed: Dec. 30, 1999

Related U.S. Application Data

(60) Division of application No. 09/357,815, filed on Jul. 20, 1999, which is a continuation-in-part of application No. PCT/JP98/00169, filed on Jan. 1, 1998.

(30) Foreign Application Priority Data

Jan. 28, 1997 (JP) ..... 9-28530
Jan. 29, 1997 (JP) ..... 9-29647

(51) Int. Cl.[7] ..... H01Q 1/36

(52) U.S. Cl. ..... 343/895; 343/713; 343/866; 343/873

(58) Field of Search ..... 343/895, 866, 343/867, 872, 873, 711, 712, 713, 715

(56) References Cited

U.S. PATENT DOCUMENTS 3,774,221 * 11/1973 Francis ..... 343/749
4,097,867 * 6/1978 Eroncig ..... 343/715
4,375,642 * 3/1983 Dorrie et al. ..... 343/895

(List continued on next page.)

FOREIGN PATENT DOCUMENTS 736926 10/1996 (EP) .
736927 10/1996 (EP) .
5-136623 6/1993 (JP) .

OTHER PUBLICATIONS

Ali, M., et al., "Short Sinusoidal Antennas for Wireless Communications," *IEEE,* 1995, pp. 542–545.
Nakano, H., et al., "Monofilar Conical–Helix Antenna With Low Pitch Angle," *IEE Proceedings,* vol. 131, Pt. II, No. 6, Dec. 1984, pp. 379–382.
Tang, C. H., "A Class of Modified Log–Spiral Antennas," *IEEE Transactions on Antennas And Propagation,* Jul. 1963, pp. 422–427.

* cited by examiner

*Primary Examiner*—Tho Phan
(74) *Attorney, Agent, or Firm*—Birch, Stewart, Kolasch & Birch, LLP

(57) ABSTRACT

An antenna for mounting on a vehicle which restrains damping of a signal voltage by reducing a stray capacitance of a signal path and has an improved antenna characteristic and a short physical length, and an antenna element which is suitable for an antenna for mounting on a vehicle and is flexible by using a helical coil of a large winding diameter are provided. In the antenna for mounting on a vehicle, with respect to a band signal having a short wavelength of a plurality of band signals to be transmitted/received, an antenna element is caused to resonate with a physical length shorter than ¼ of the wavelength of the band signal. A linear line portion is provided at the proximal end, and the antenna element is provided at a predetermined distance from vehicle body and a conductive member of the same electric potential as the vehicle body. The stray capacitance between the proximal end portion of the antenna element and the vehicle body is small, and a signal voltage is outputted without being damped. The antenna element is formed by burying a helical coil coaxially into a flexible insulating resin pipe. The pitch of the helical coil is not shifted even when it is bent repeatedly. Also, no sink mark is generated in the insulating resin pipe.

25 Claims, 12 Drawing Sheets

U.S. PATENT DOCUMENTS

| | | | | |
|---|---|---|---|---|
| 4,379,298 | * | 4/1983 | Vincent et al. | 343/895 |
| 4,435,713 | * | 3/1984 | Gasparaitis et al. | 343/702 |
| 4,914,450 | * | 4/1990 | Dilley et al. | 343/895 |
| 5,216,436 | | 6/1993 | Hall et al. | 343/895 |
| 5,300,940 | | 4/1994 | Simmons | 343/749 |
| 5,341,149 | | 8/1994 | Valimaa et al. | 343/895 |
| 5,661,495 | * | 8/1997 | Saldell | 343/702 |
| 6,034,650 | * | 3/2000 | Kuramoto | 343/895 |

10
20
20a
20b
20c
20d
44
44a
44b
48
A

ANTENNA FOR MOUNTING ON VEHICLE, ANTENNA ELEMENT AND MANUFACTURING METHOD THEREOF

This application is a divisional of application Ser. No. 09/357,815, filed on Jul. 20, 1999. Which is a continuation of PCT International Application No. PCT/JP98/00169 filed on Jan. 1, 1998. The entire contents of each of the above-identified applications are hereby incorporated by reference.

TECHNICAL FIELD

The present invention is related to an antenna for mounting on vehicle operable as an antenna with respect to plural band signals such as AM/FM bands, the physical length of which is shortened. Also, the present invention is related to an antenna element and a method for manufacturing such an antenna element which is suitable for this antenna for mounting on vehicle, and employs a helical coil capable of having a large winding diameter and also having flexibility.

BACKGROUND OF THE INVENTION

Conventionally, as a general-purpose antenna functioning as an on-vehicle AM/FM antenna, a telescope-shaped multi-stage rod antenna is constructed in such a manner that this rod antenna can be freely projected and also freely retracted, or withdrawn. Then, this rod antenna is set in such a manner that this physical projection length is approximately 1 m, and the physical length becomes approximately an ¼ wavelength of the FM band signal under projection condition, so that the FM band signal can be resonated.

In the conventional antenna structure, the structure for projecting the rods, or the structure for retracting the rods is complex. Also, it is not preferable that such along antenna having a length of approximately 1 m is projected from a vehicle body.

Also, antenna elements with employment of helical coils are widely used, by which physical, or aerial, lengths can be sufficiently made short, as compared with the antenna effective lengths. Moreover, there are many cases that this antenna element is constituted by having flexibility so as to protect this antenna element from breakage. As one structural example of these conventional antenna elements, a helical coil is wound on an insulating resin rod having flexibility, an insulating resin pipe having thermal shrinkage is used to cover this wound helical coil, and then, the helical coil is fixed on the insulating resin rod by utilizing shrinkage of this pipe. Also, as an antenna element used in a microwave band, a helical coil having a relatively small winding diameter is embedded in an insulating resin rod having flexibility by way of the insert molding.

Therefore, the inventors have invented the following antenna as the technique capable of operating as an antenna for mounting on vehicle having a shorter projection length. That is, while the helical coil antenna was employed, the physical length of this helical coil antenna was selected to be approximately 15 cm, and also made shorter than an ¼ wavelength of the FM band signal. Moreover, while the antenna effective length was selected to be approximately 1 m, the FM band signal could be resonated.

In accordance with this technique, since the physical length is made shorter, the length of the helical coil antenna which is projected from the vehicle body can also be made shorter, resulting in an improvement of the outer view. Moreover, the antenna characteristic with respect to the FM band signal could have the substantially same effect as that of the conventional antenna for mounting on vehicle, the projection length of which is approximately 1 m.

However, it is recognized that the antenna characteristic of the helical coil antenna with respect to the AM band signal is deteriorated. In this case, even in the conventional antenna whose projection length is approximately 1 m, the AM band signal is not resonated, but the output impedance of the antenna represents the capacitive characteristic. Also, the external load represents the capacitive characteristic, which is caused by the cable and the like connected to the antenna base terminal. The voltage of the signal received by the antenna is subdivided by both the output impedance of the antenna and the external load impedance such as the cable to constitute the essential antenna output. For example, assuming now that in the conventional antenna having the projection length of approximately 1 m, the capacitance of the antenna output impedance is 10 pF and also the capacitance of the external load impedance such as the cable is 100 pF, when these capacitances are converted into AC resistance values R1 and R2, the AC resistance value R1 becomes about 16 KΩ and the AC resistance value R2 becomes 1.6 KΩ. The antenna output would become approximately an 1/10 of the signal voltage VA. To improve this aspect, the capacitances of the cable and the like are reduced as small as possible, whereas the AC resistance value R2 of the external load impedance is increased as large as possible. However, impractical case, there are limitations in improvements of the cable and the like.

As a result, as previously explained with respect to the above-described technique, when the physical length of the helical coil antenna is made shorter, the output impedance of the antenna represents the larger capacitive characteristic. Thus, the AC resistance value R1 would exceed, for example, 50 KΩ. Also, since the projection length of this helical coil antenna is made shorter, the signal voltage would be lowered. As a consequence, the antenna output of the AM band signal is largely attenuated, namely should become considerably small, as compared with those of the conventional antenna.

Also, as to the conventional antenna element in which the helical coil is fixed on the insulating resin rod by using the insulating resin pipe having the thermal shrinkage characteristic, the winding diameter of the helical coil can be freely set, and thus, the freedom degree in design is high. However, there is the difficulty that when the helical coil antenna element is repeatedly bent, the coil pitch of this helical coil is shifted to be readily made unequal, and therefore, the antenna characteristic would be changed. Also, in such an antenna element that the helical coil is embedded into the insulating resin rod by way of insert molding, even when this antenna element is repeatedly bent, there is no difficulty that the coil pitch of this helical coil is shifted. However, when the winding diameter of this helical coil is increased so as to enlarge the diameter of the insulating resin rod, a "drop" would be readily produced during the resin molding, and thus, the ratio of defective products to good products would be increased in the manufacturing stage. As a result, this helical coil antenna element could be applied only to a helical coil antenna element having a relatively small winding diameter, for example, the winding diameter must be smaller than, or equal to 2.0 mm.

SUMMARY OF THE INVENTION

The present invention has an object to provide an antenna for mounting on vehicle having a short physical length, while an attenuation of an output voltage from an antenna element is suppressed by improving an external load impedance to thereby improve an antenna characteristic. Also, the present invention has another object to provide an antenna element suitable for an antenna for mounting on vehicle and a method for manufacturing this antenna element, which can employ a helical coil having a large winding diameter, and furthermore, has flexibility.

To achieve the objects, an antenna for mounting on vehicle, according to the present invention, an antenna element is formed in such a manner that a physical length of the antenna element is made shorter than an ¼ wavelength of a band signal among a plurality of band signals to be transmitted/received, and also the antenna element is resonated by an electric delay structure with respect to the band signal having the shorter wavelength; a signal path member is provided at a base end of this antenna element; and the antenna element is arranged in such a manner that this antenna element is separated from both the vehicle body and an electric conductive member at the same potential as that of the vehicle body. Also, an antenna for mounting on vehicle, according to the present invention, is featured by that an antenna element is formed in such a manner that a physical length of the antenna element is made shorter than an ¼ wavelength of a band signal among a plurality of band signals to be transmitted/received, at least a base end portion thereof is formed in a narrow taper shape, and also the antenna element is resonated by an electric delay structure with respect to the band signal having the shorter wavelength and a signal path member is provided at the base end of this antenna element. In accordance with these antenna for mounting on vehicles, the stray capacitance formed between the base end portion of the antenna element and the vehicle body can be reduced, and the attenuation of the signal voltage of the antenna element can be suppressed.

Also, an antenna element, according to the present invention, is featured by that the antenna element is arranged in such a setting condition that while an outer diameter of an insulating resin pipe having flexibility and an outer diameter of a helical coil are set on the same plane, the helical coil is embedded into the insulating resin pipe in a coaxial manner. Furthermore, an antenna element manufacturing method, according to the present invention, is featured by that the antenna element is constituted in such a way that an outer diameter of a helical coil is surrounded while being depressed by a mold; a center mold having an outer diameter smaller than an inner diameter of the helical coil is arranged on the helical coil in a coaxial manner; and an insulating resin having flexibility is formed in a pipe shape by way of insert molding. In accordance with the above-explained antenna element manufacturing method, even when the antenna element is repeatedly bent, the pitch of the helical coil is not positionally shifted. Moreover, even when the helical coil is formed with having the large winding diameter, there is no risk that a "drop" is produced in the insulating resin pipe to be insert-molded.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein:

FIG. 3(*a*) shows an antenna element formed in a zigzag shape;

FIG. 3(*b*) indicates an antenna element formed in a sinuously folded shape along a transverse direction; and FIG. 3(*c*) represents an antenna element formed in a sinuously folded shape along a longitudinal direction.

FIG. 4(*a*) illustrates an antenna element formed in a zigzag shape;

FIG. 4(*b*) illustrates an antenna element formed in a sinuously folded shape along a transverse direction; and FIG. 4(*c*) illustrates an antenna element formed in a sinuously folded shape in a substantially redial direction from the base end.

FIG. 5(*a*) illustrates an antenna element formed in a sinuously folded shape along a transverse direction; and FIG. 5(*b*) represents an antenna element formed in a sinuously folded shape along a longitudinal direction.

FIG. 6(*a*) illustrates an antenna element formed in a sinuously folded shape along a transverse direction; and FIG. 6(*b*) illustrates an antenna element formed in a sinuously folded shape along a longitudinal direction.

FIG. 9(*a*) is a sectional view of this antenna element;

FIG. 9(*b*) is an enlarged sectional view, taken along a line A to A of FIG. 9(*a*);

FIG. 9(*c*) is an enlarged sectional view for showing a major portion of a coupling reinforcement portion formed with an insulating resin pipe in an integral form; and FIG. 9(*d*) is a view after being changed in parts of FIG. 9(*c*).

FIG. 14(*a*) is a sectional view for showing this antenna element; and

FIG. 14(*b*) is an enlarged sectional view for indicating the antenna element, taken along a line B to B thereof.

DETAILED DESCRIPTION

Figure 1:
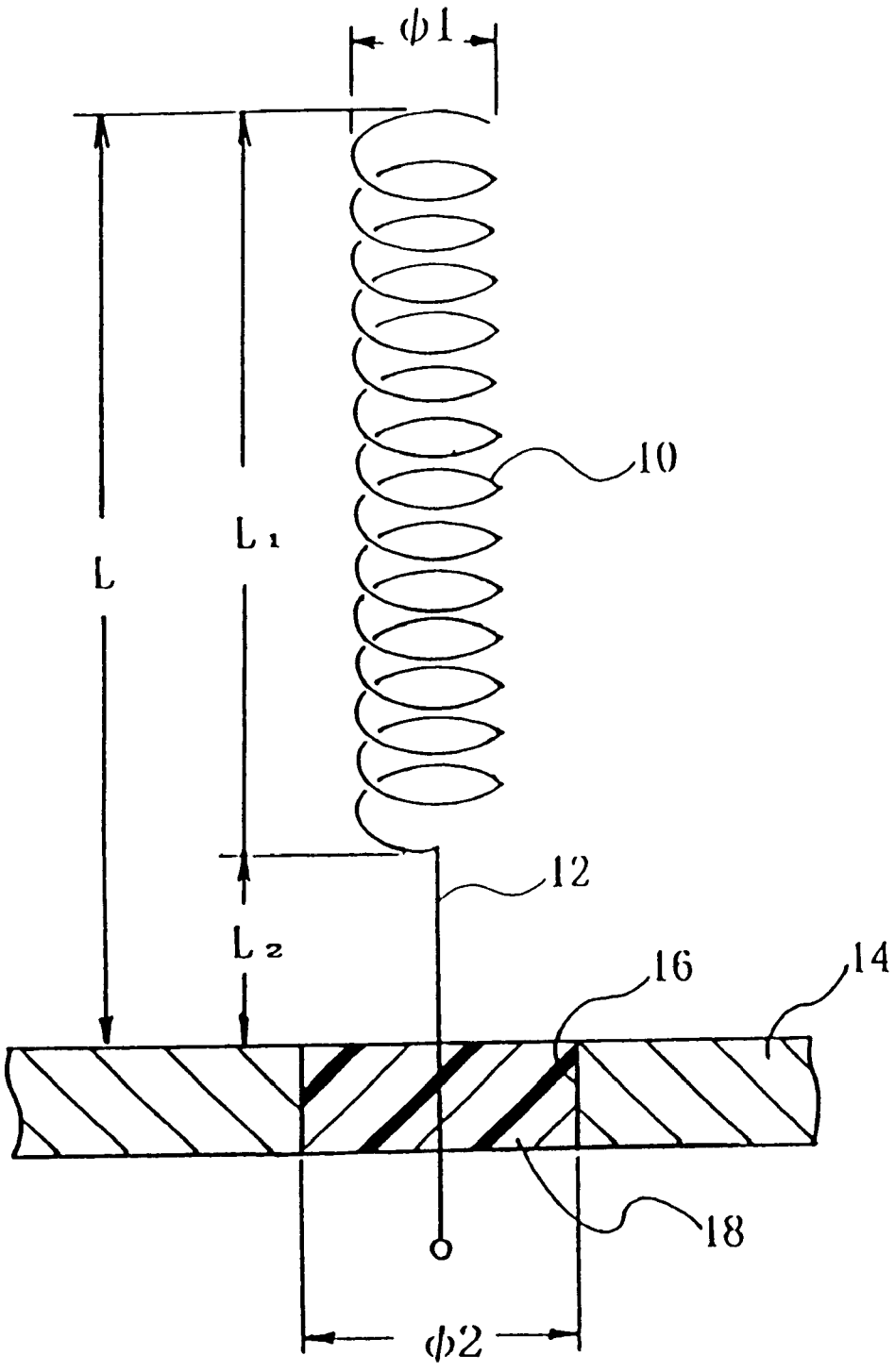
FIG. 1 is a structural diagram of an antenna for mounting on vehicle according to a first embodiment of the present invention.

Referring now to the accompanying drawings, the present invention will be described more in detail.

An antenna for mounting on vehicle according to the present invention will now be explained as an example of an AM/FM antenna with reference to FIG. 1 and FIG. 2. First, an antenna element 10 is formed by a helical coil functioning as an electrical delay structure. An antenna effective length of this antenna element 10 is set under such a state that an FM band signal can be resonated. However, a physical length "L1" of this antenna element 10 is apparently made shorter than, or equal to an ¼ wavelength of the FM band signal. Then, a straight line shaped coil portion 12 functioning as a signal path member is extended from a base end of this antenna element 10. This straight line shaped coil portion 12 is penetrated through a hole 16 formed in a vehicle body 14 functioning as the ground. Also, a dielectric material 18 is interposed as a supporting member between the straight line shaped coil portion 12 and an edge of the hole 16. Furthermore, the base end of the antenna element 10 is arranged in such a manner that this base end is separated from the vehicle body 14 by a distance L2 by the straight line shaped coil portion 12. The antenna for mounting on vehicle of the present invention is arranged by the above-explained structures. It should be understood that an electric conductive member owns the same electric effect as that of the vehicle body 14, and this electric conductive member will be explained in combination with the vehicle body 14. The electric potential at this electric conductive member is the same as that of the vehicle body 14 such as a top nut and the like, which are used to fix the antenna for mounting on vehicle on the vehicle body 14.

Figure 2:
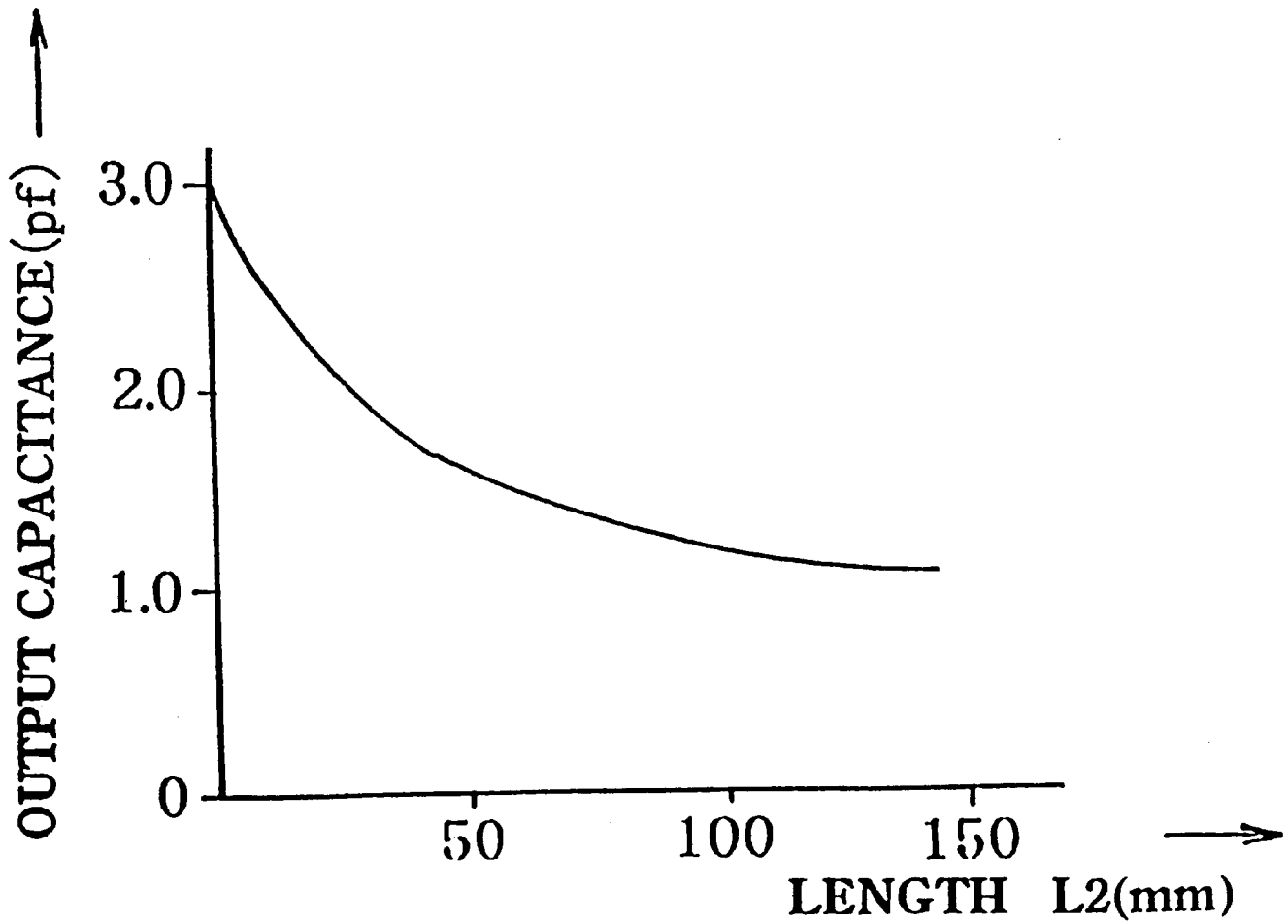
FIG. 2 is a graphic representation for representing an antenna output capacitance under such a condition that while an entire length "L" of the antenna for mounting on vehicle of FIG. 1 is made constant, a length "L2" thereof is varied.

FIG. 2 is a graphic representation of an antenna output capacitance in such a case that while a summation "L" between the physical length "L1" of the antenna element 10 and an distance "L2" is kept as a constant value of 150 mm and this distance "L2" is defined between the antenna element 10 and the vehicle body 14, this distance L2 is changed. In this case, a winding diameter "ϕ1" of the helical coil is equal to 10 mm, a coil material is a solid wire having a diameter of 0.5 mm, and a diameter "ϕ2" of the hole 16 is equal to 20 mm.

As apparent from the graphic representation of FIG. 2, while the distance "L2" is short, the closer the base end of the antenna element 10 is reached to the vehicle body 14, the larger the antenna output capacitance is increased. Then, the longer the distance "L2" becomes, the smaller the antenna output capacitance is decreased. It should also be understood that since the distance "L2" is increased, the physical length "L1" of the antenna element 10 is shortened, and the coil pitch must be made close. Finally, since the antenna characteristic with respect to the FM band signal would be deteriorated, there is a practical limitation. As seen from FIG. 2, since the distance "L2" is selected to be 50 mm, the antenna output capacitance becomes approximately a half of the antenna output capacitance when the distance "L2" becomes 0 mm.

Considering these facts, when the antenna characteristic of the antenna for mounting on vehicle by setting the distance "L2" to 50 mm is measured, the reception sensitivity of the antenna output with respect to the AM band signal could be largely improved by approximately 6 dB, as compared with the reception sensitivity when the distance "L2" is set to 0 mm. This improvement can be achieved by the following reason. Since the antenna element 10 is separated from the vehicle body 14 by the distance "L2" by employing the straight line shaped coil portion 12, the stray capacitance produced between the antenna element 10 and the vehicle body 14 is largely reduced, the external load impedance is increased, and thus, the voltage dividing ratio of the signal voltage VA can be greatly improved.

In the above-described embodiment, since the base end of the antenna element 10 is arranged by being separated from both the vehicle body 14 and the electric conductive member at the same potential as that of the vehicle body 14, the stray capacitance produced between the base end portion of the antenna element 10 and the vehicle body 14 can be suppressed. As a result, the signal voltage of the antenna element 10 can be output with being attenuated. As a consequence, even when the physical length of the antenna element 10 is short because of the electric delay structure, the antenna characteristic with respect to such a band signal having a longer wavelength, which cannot be resonated for this antenna element 10, can be improved. Also, since the antenna element 10 is formed by using the helical coil, it is possible to relatively easily constitute the antenna element 10 having a desirable characteristic by properly setting the winding diameter thereof and the pitch thereof. As a consequence, the antenna for mounting on vehicle can be easily manufactured. Then, also, since the straight line shaped coil portion 12 is extended from the base end of the antenna element 10 so as to constitute the signal path member, the line material for constituting the antenna element 10 may be merely formed in a straight form at the base end thereof, and thus, the antenna element can be made in a simple manner. Moreover, since the surface area of the straight line shaped coil portion 12 is small, the resulting stray capacitance becomes small.

Figure 3:
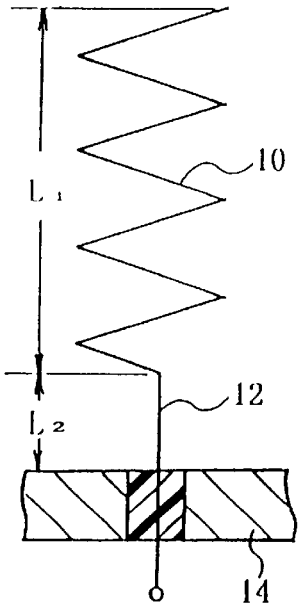
FIG. 3 illustrates another structure of an antenna element provided on one plane, which is employed in the antenna for mounting on vehicle of the present invention.
Figure 3:
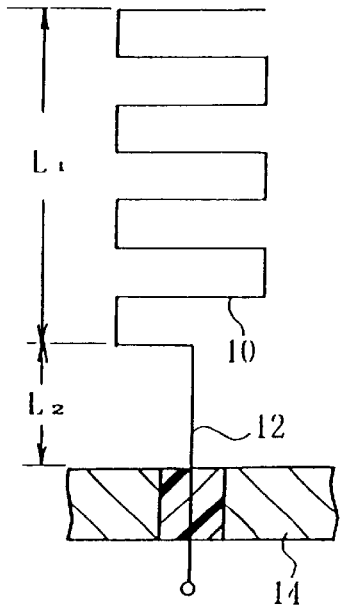
Figure 3:
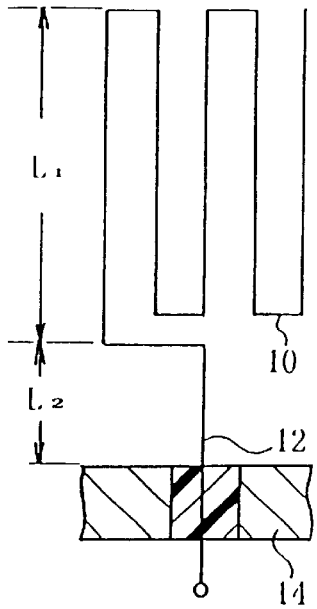

FIG. 3 indicates another structure of an antenna element 10 provided on one plane, which is employed in the antenna for mounting on vehicle of the present invention; FIG. 3(*a*) shows an antenna element formed in a zigzag shape; FIG. 3(*b*) indicates an antenna element formed in a sinuously-folded shape along a transverse direction; and FIG. 3(*c*) represents an antenna element formed in a sinuously folded shape along a longitudinal direction.

In accordance with the embodiment shown in FIG. 3, since the antenna element 10 is formed on one plane, this antenna element 10 can be arranged by a pattern formed on a printed wiring line board, so that this antenna element 10 can be suitably manufactured in mass production.

On the other hand, since the antenna element 10 shown in FIG. 3 owns the wide base end and therefore may easily produce a stray capacitance between this antenna element 10 and the vehicle body 14, the antenna element 10 must be separated from the vehicle body 14 by the distance "L2" by way of the straight line shaped coil portion 12. However, if the width of the base end of the antenna element 10 is made narrower, then the resultant stray capacitance becomes small even when such a stray capacitance would be produced. An antenna for mounting on vehicle formed based on this technique is indicated in FIG. 4.

Figure 4:
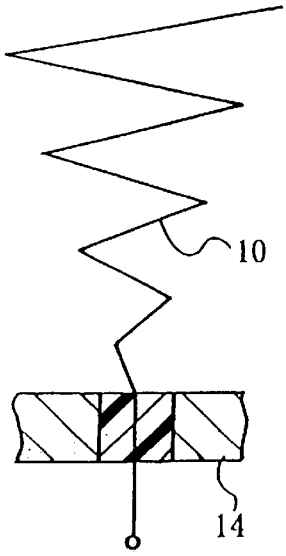
FIG. 4 illustrates a further structure of an antenna element provided on a plane, the base end of which is made in a narrow taper shape, and which is used in the antenna for mounting on vehicle of the present invention.
Figure 4:
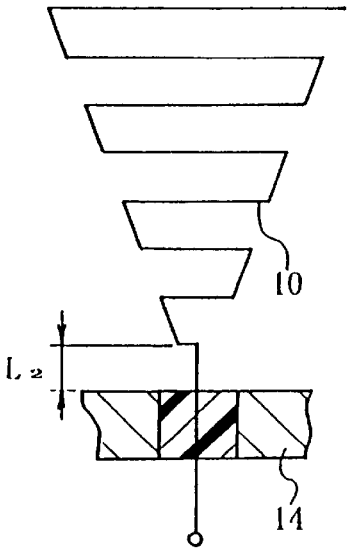
Figure 4:
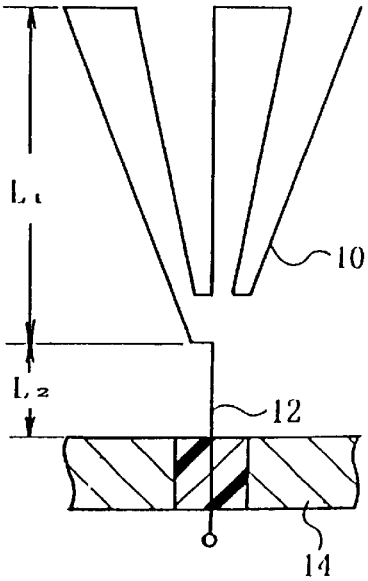

FIG. 4 shows a further structure of an antenna element 10 provided on one plane, the base end of which is made in a narrow taper shape, and which is used in the antenna for mounting on vehicle of the present invention; FIG. 4(*a*) shows an antenna element formed in a zigzag shape; FIG. 4(*b*) indicates an antenna element formed in a sinuously folded shape along a transverse direction; and FIG. 4(*c*) represents an antenna element formed in a sinuously folded shape in a substantially radial direction from the base end.

With respect to the antenna element 10 shown in FIG. 4(*a*), a width of a base end is very narrow, a straight line shaped coil portion is substantially equal to the straight line shaped coil portion 12 shown in FIG. 1 and FIG. 3. However, such a distance "L2" shown in FIG. 1 and FIG. 3 is not required. Also, even in the antenna element indicated in FIG. 4(*b*), a width of a base end is narrow and only a small distance L2 is merely required to from the antenna element. Then, in such an antenna element as shown in FIG. 4(*c*), although a width of a base end is narrow, the base end of the antenna element 10 may be separated from the vehicle body 14 by a distance "L2" by employing the straight line shaped coil portion 12 in order to furthermore improve the antenna characteristic.

In the embodiment shown in FIG. 4, since the base end of the antenna element 10 is formed in a narrow taper shape, the stray capacitance produced between this base end and the on-vehicle body 14 can be suppressed. As a result, even when the base end of the antenna element 10 is not necessarily separated from both the vehicle body 14 and the electric conductive member at the same potential as that of this on-vehicle body 14, such an antenna characteristic can be improved with respect to the band signal having the longer wavelength, which can not be resonated for this antenna element 10.

Figure 5:
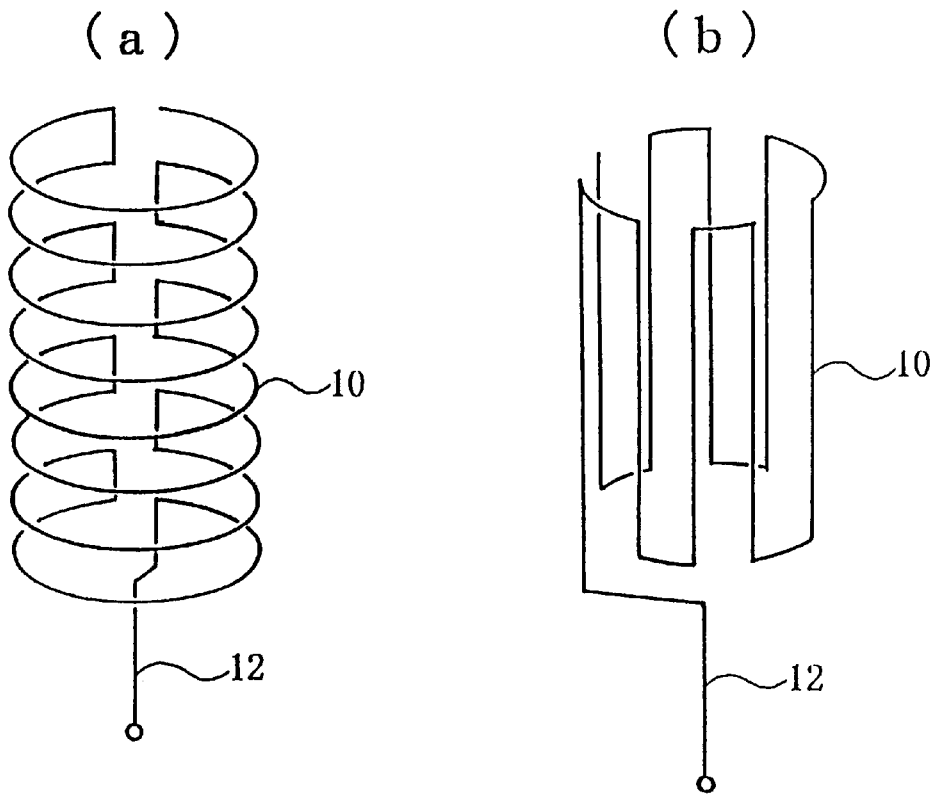
FIG. 5 illustrates a still further structure of an antenna element provided on a cylindrical surface, which is employed in the antenna for mounting on vehicle of the present invention.

FIG. 5 indicates another structure of an antenna element 10 provided on a cylindrical plane, which is employed in the antenna for mounting on vehicle of the present invention; FIG. 5(*a*) indicates an antenna element formed in a sinuously folded shape along a transverse direction; and FIG. 5(*b*) represents an antenna element formed in a sinuously folded shape along a longitudinal direction.

In the antenna element 10 shown in FIG. 5, a straight line shaped coil portion 12 is extended from a center portion of a base end thereof. Then, this base end of this antenna element 10 is provided apart from the vehicle body 14. It should also be understood that the present invention is not limited to this antenna element provided on the cylindrical surface, but also may cover such an antenna element provided on a three-dimensional surface having a properly selected pyramid shape such as a rectangular pillar shape and a hexagonal pillar shape.

Figure 6:
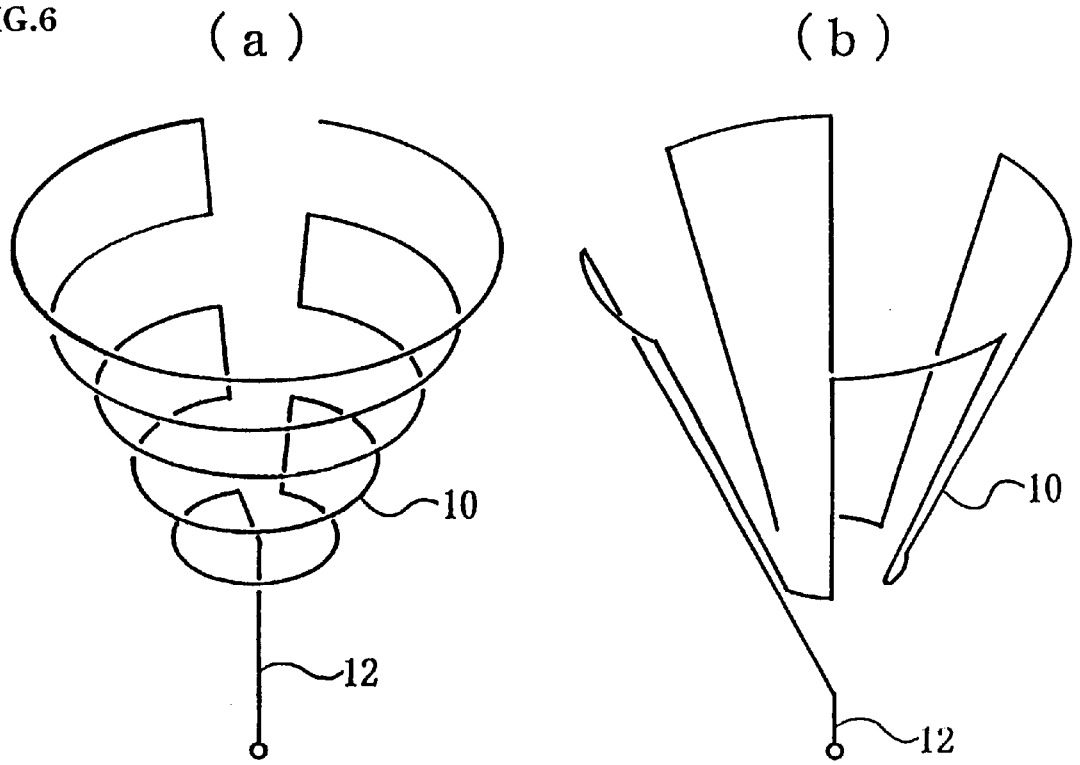
FIG. 6 illustrates a further structure of an antenna element, the base end of which is provided on a narrow circular-cone shape, and which is employed in the antenna for mounting on vehicle of the present invention.

FIG. 6 shown a further structure of an antenna element 10, the base end of which is provided on a narrow circular-cone shape, and FIG. 6(*a*) indicates an antenna element formed in a sinuously folded shape along a transverse direction; and FIG. 6(*b*) represents an antenna element formed in a sinuously folded shape along a longitudinal direction.

As to the antenna element 10 indicated in FIG. 6, a width of a base end thereof is narrow, and this base end is not always separated from the vehicle body 14. As a result, such a straight line shaped coil portion 12 is merely provided which has a length, by which this straight line shaped coil portion 12 is penetrated from the base end to the vehicle body 14. In this case, it is of course possible to arrange that the base end of the antenna element 10 may be separated from the vehicle body 14. It should also be understood that the present invention is not limited to this antenna element provided on the cylindrical surface, but also may cover such an antenna element provided on a plane having a properly selected pyramid shape such as a rectangular pillar shape and a hexagonal pillar shape.

Figure 7:
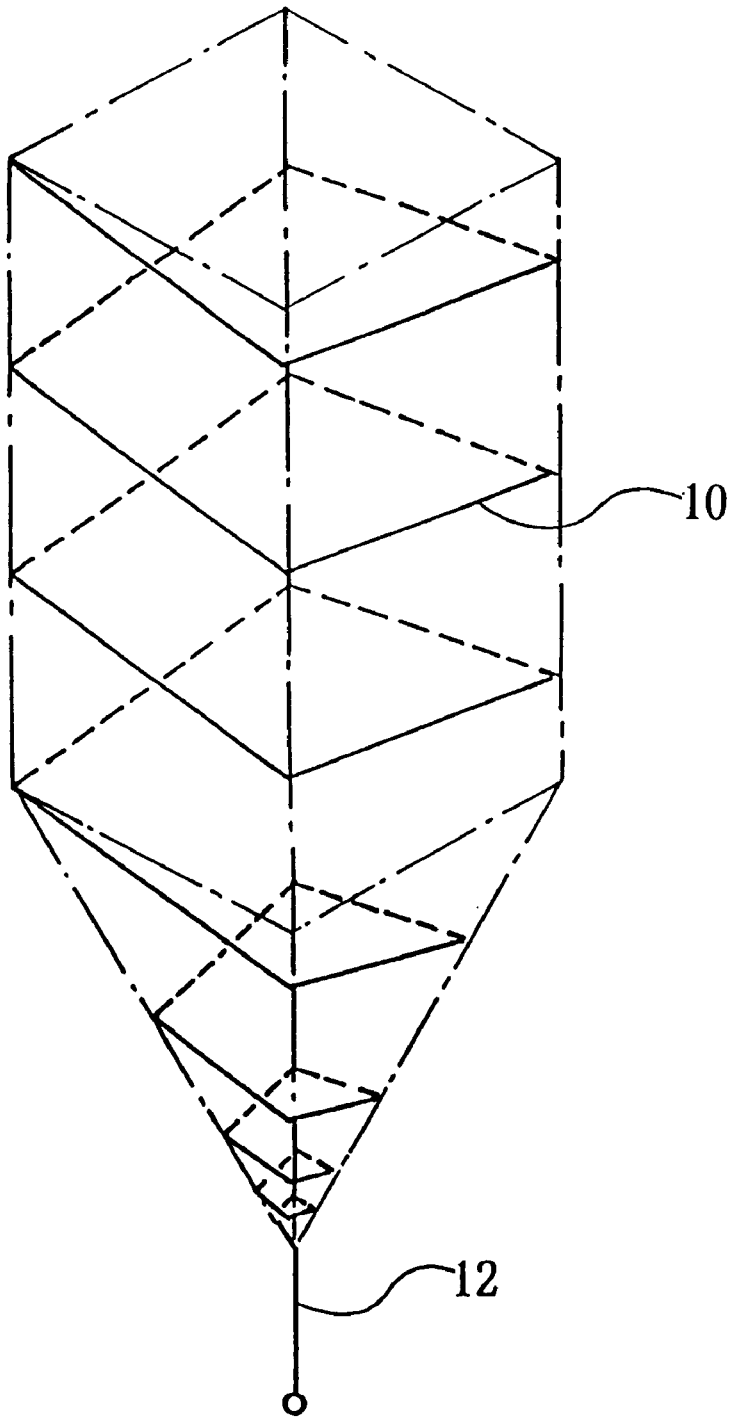
FIG. 7 illustrates a further structure of an antenna element employed in the antenna for mounting on vehicle of the present invention, which is provided in a helical shape on a pyramid surface coupled to a rectangular pillar shape and a base end thereof.

FIG. 7 represents a further structure of an antenna element 10 employed in the antenna for mounting on a vehicle of the present invention, which is provided in a helical shape on a pyramid surface coupled to a rectangular pillar shape and a base end thereof.

As to the antenna element 10 shown in FIG. 7, a straight line shaped coil portion 12 is extended from a base end thereof, and the base end of the antenna element 10 is arranged so that this base end is separated from the vehicle body 14, or is not separated therefrom.

In the respective embodiments shown in FIG. 5 to FIG. 7, the antenna element 10 is formed on the three-dimensional plane, and this antenna element 10 can be manufactured similar to the helical coil by that the physical length thereof can be shortened and also the antenna for mounting on vehicle can be formed within a small space.

Figure 8:
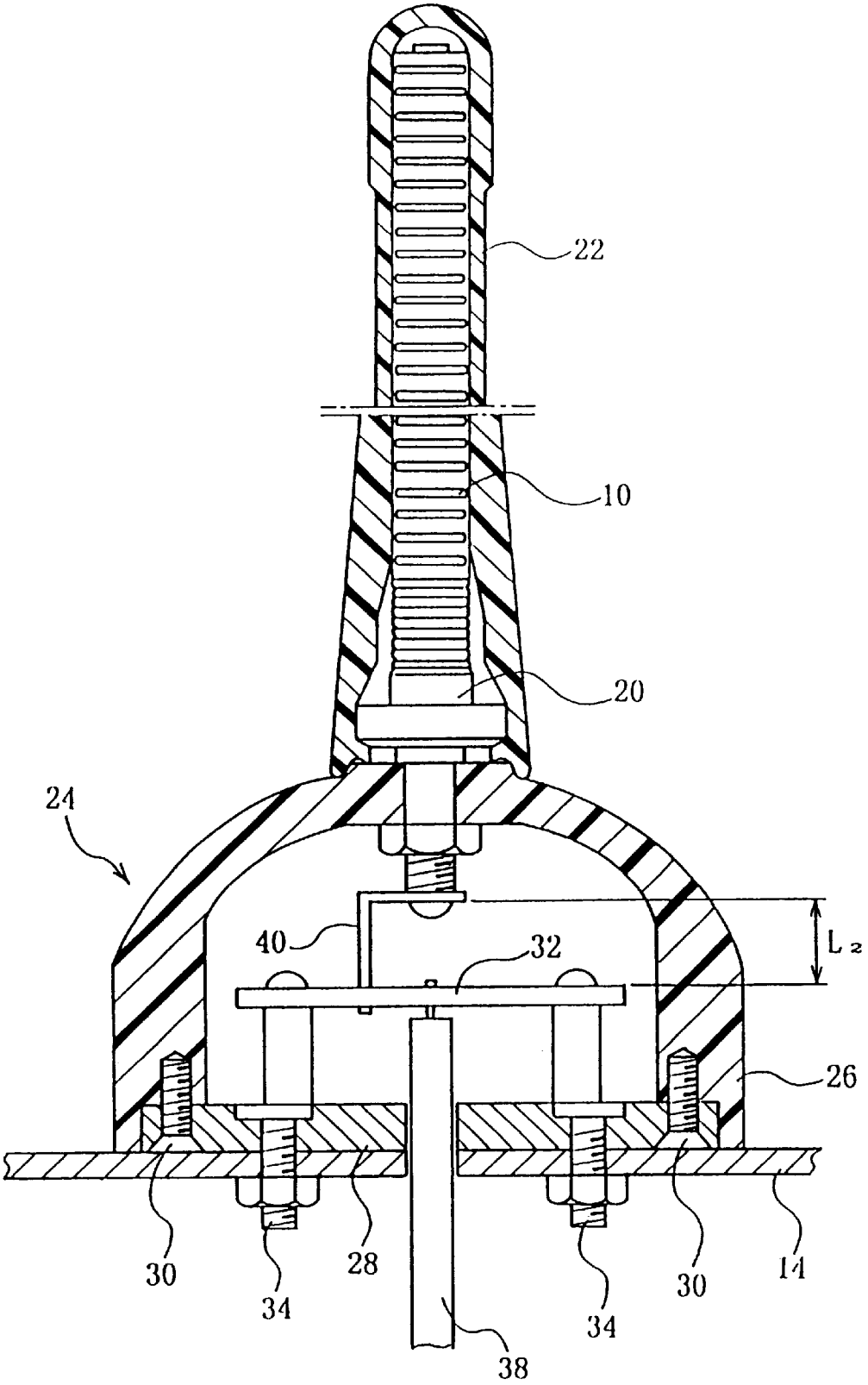
FIG. 8 is a structural diagram for showing that the antenna for mounting on vehicle of the present invention is applied to an antenna apparatus attached to an outer surface of a vehicle body.

Next, referring to FIG. 8, a description will be made of a structure such that the antenna for mounting on vehicle of the present invention is applied to an antenna apparatus attached to an outer surface of the vehicle body 14. In FIG. 8, a base end of an antenna element 10 constituted by a helical coil is fixed to a mounting fixing member 20 made of an electrically conductive material, and also is electrically connected thereto. The antenna element 10 is covered by an antenna cover 22 made of an insulating resin. A base housing 24 is subdivided into two sets of upper/lower housings. The upper housing 26 made of an insulating resin provided at the upper side is assembled with the base fitting member 28 made of an electric conductive material provided at the lower side by screws 30 and 30 so as to be fixed. The mounting fixing member 20 is fixed to the upper housing 26 by screwing with a nut or the like. Then, a board 32 used to form either an amplifying circuit or a matching circuit is fixed to the base fitting member 28 and then, is stored into the base housing 24. Also, this base fitting member 28 is fixed to the vehicle body 14 by using mounting bolts 34 and 34 made of an electrically conductive material, and also is electrically connected thereto. Then, a coaxial cable 38 which is penetrated through both the base fitting member 28 and the vehicle body 14 is electrically connected to the board 32. Furthermore, one edge of a belt-shaped plate member 40 made of an electric conductive material, which functions as a signal path member, is fixed to the mounting fitting member 20 projected from the base housing 24 by way of a screw, and furthermore, is electrically connected thereto. The other edge of this plate member 40 is fixed to the board 32 and also is electrically connected thereto.

In the antenna for mounting on vehicle having the above-described structure, an earth pattern and the like used to form the circuits are provided on the board 32, so that there is a place made of the electrically conductive member at the same potential as that of the vehicle body 14. As a consequence, since the mounting fitting member 20 functioning as the base end of the antenna element 10 is electrically connected via the plate member 40 to the board 32, the space defined between the base end of the antenna element 10 and the board 32 having the electric conductive member of the same potential as that of the vehicle body 14 can be separated by "L2". As a result, the stray capacitance produced between the base end of the antenna element 10 and the electric conductive member at the same potential as that of the vehicle body 14 of the board 32 can be reduced.

In this case, the plate member 40 is formed in such a manner that when one end of this plate member 40 is fixed to the mounting fitting member 20, the attitude thereof is kept constant and up-stood. In comparison with employment of an electric conductive line having high flexibility , the plate member 40 can be readily assembled to the board 32 so as to be electrically connected thereto. Then, this plate member 40 may be freely manufactured of the manufactured plate member owns a shape capable of reducing a stray capacitance. Furthermore, the present invention is not limited to such a plate-shaped member, but also may be realized by employing a copper line capable of having rigidity. In addition, an electric conductive line having flexibility may be employed if the proper assembling manner could be found out.

It should also be noted that the electric delay structure for constituting the antenna element 10 is not limited to those as described in the above-explained embodiments. Alternatively, any types of electric delay structures may be employed when the physical lengths corresponding to the antenna effective lengths which may be resonated with respect to the band signals having the short wavelengths may be made shorter than the ¼ wavelengths of these band signals. Then, a plurality of band signals which should be transmitted/received are not limited to the AM/FM band signal, but also may cover both an FM band signal and a PHS band signal, and a combination of an AM band signal, an FM band signal, and an automobile telephone band signal. Also, apparently, the antenna for mounting on vehicle of the present invention may be limitedly used to receive the AM/FM band signals, or transmit the AM/FM band signals. Furthermore, the expression "to be transmitted/received" implies not only transmission/reception but also either transmission nor reception.

Moreover, the antenna element 10 and the straight line shaped coil portion 12 in the above-described embodiment may be manufactured by the wires so as to be up-stood. When these antenna element 10 and straight line shaped coil portion 12 are provided on one plane, these members may be formed by providing the patterns on a printed wiring line board having no flexibility. Furthermore, when these antenna element 10 and straight line shaped coil portion 12 are provided on a three-dimensional plane, these members may be formed in such a manner that while the patterns are formed on the printed wiring line board having the flexibility, these members are provided near the pillar-shaped body, or the frustum. Alternatively, these antenna element 10 and straight line shaped coil portion 12 may be arranged by vapor-depositing, or plating manner on the surface of the pillar-shaped body, or the pyramid. At least, this surface is made of an insulating member.

Then, also, in the case that the antenna element 10 and the straight line shaped coil portion are provided on the three-dimensional body such as the pillar-shape body, or the pyramid, these members are not limited to the above-described embodiment, but also may be realized by, for example, the frustum; a body, the taper inclination of which is changed in a half way; and another body, the inclination change of which is curved.

Figure 9:
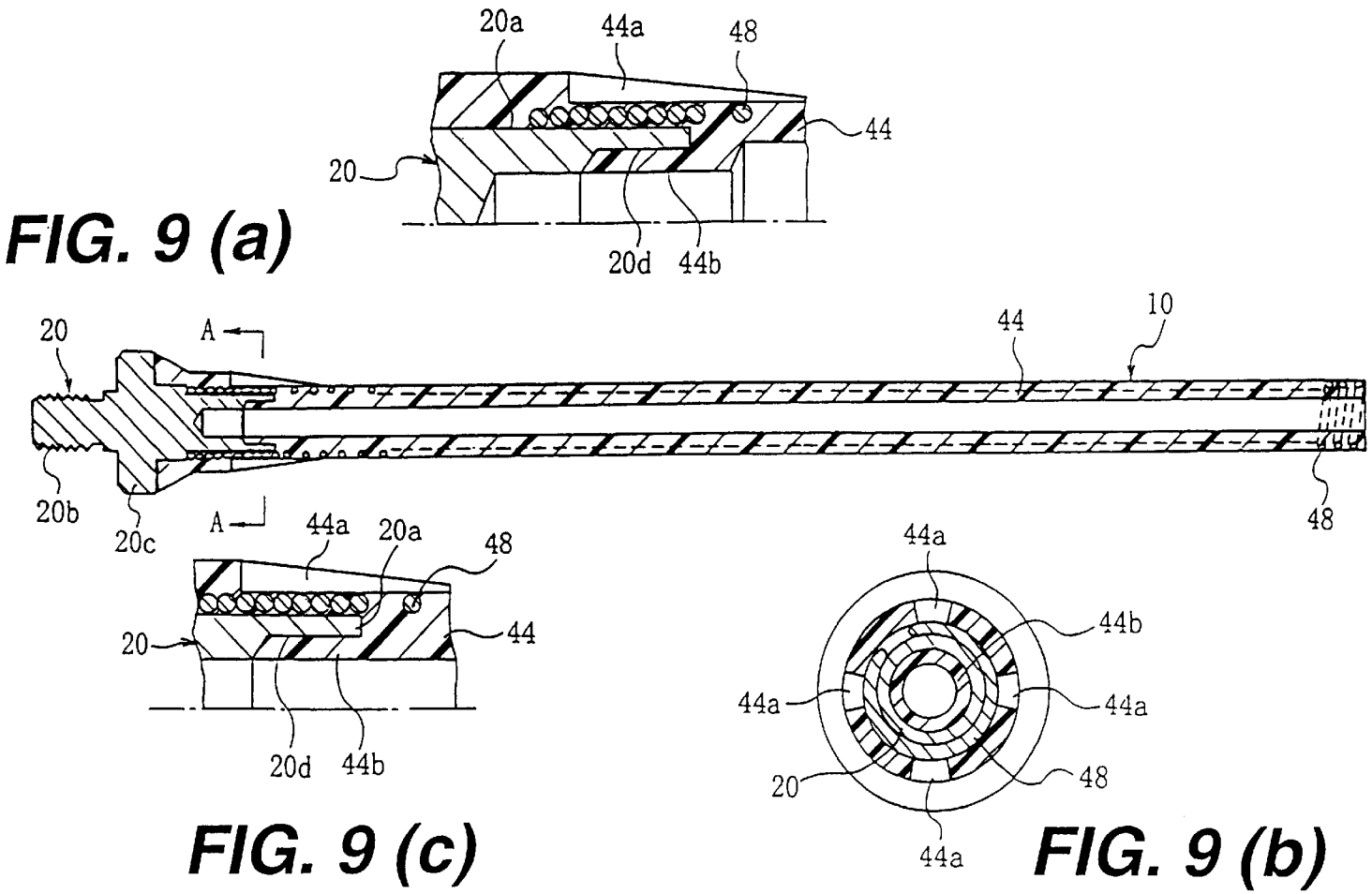
FIG. 9 illustrates a structure of an antenna element according to a first embodiment of the present invention.
Figure 10:
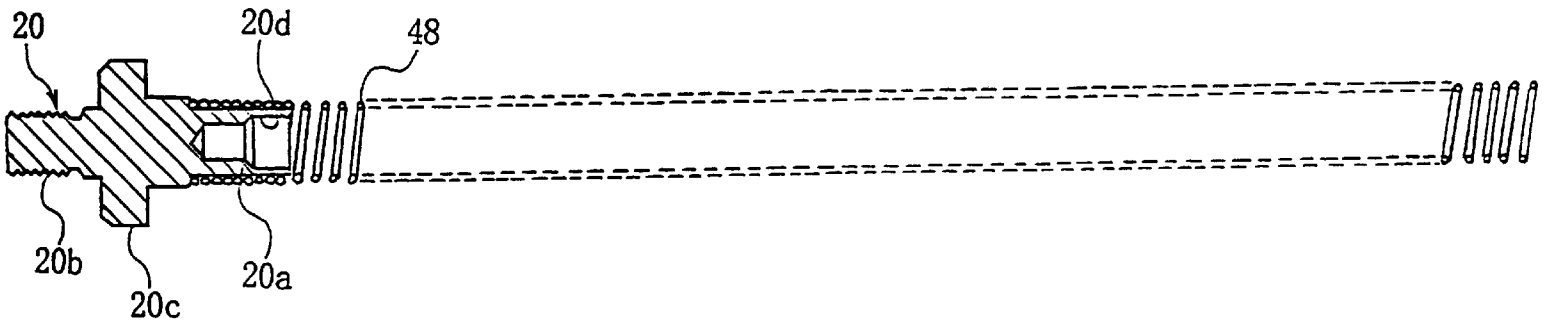
FIG. 10 is a sectional view for showing that a helical coil is assembled with a mounting fitting member.
Figure 11:
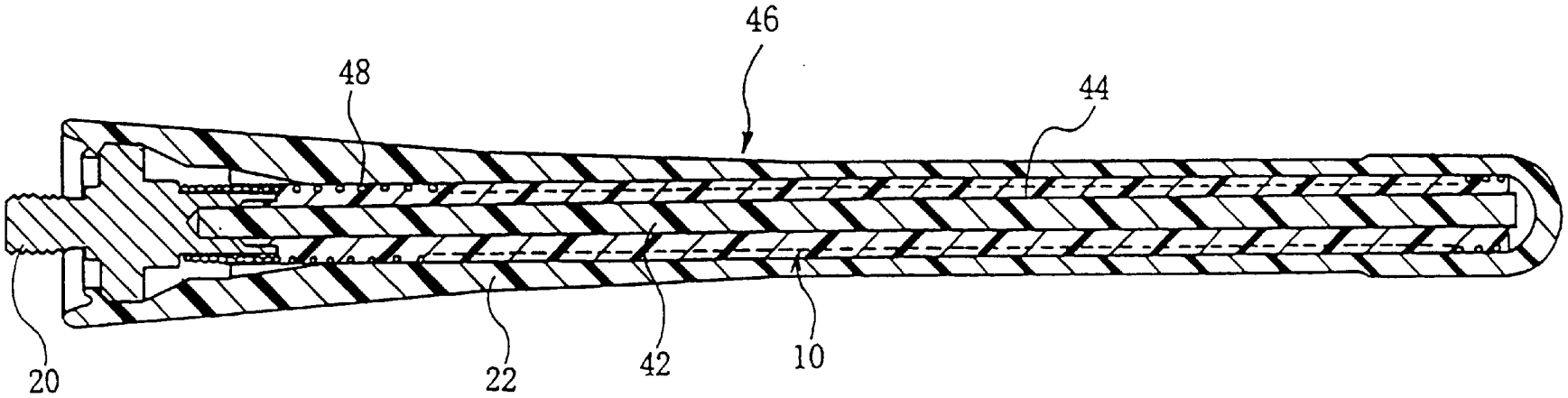
FIG. 11 is a sectional view for representing an antenna apparatus to which the antenna element of the present invention is assembled.

Subsequently, a description will now be made of an antenna 10 suitably employed in the above-described antenna for mounting on vehicle. First, a first embodiment of the antenna element 10 of the present invention will be explained with reference to FIG. 9 to FIG. 11. In FIG. 9 to FIG. 11, the helical coil 48 is formed in order that both the AM band signal and the FM band signal can be received as follows: That is, an electric conductive line having a diameter of 0.5 mm is wound under such a condition that an outer diameter of the wound coil is approximately 6 mm; a turn number of this wound coil is approximately 100, a physical length of this wound coil along an axial direction is approximately 15 cm; and an antenna effective length is approximately 1 m. One edge portion of this helical coil is formed in the tight winding. Then, the edge portion of the tight winding of the helical coil 48 is engaged with an outer peripheral portion of a cylindrical portion 20*a* which is projected from the mounting fitting member 20 made of the electric conductive material, and then, is properly fixed thereon by soldering. A male screw 20*b* is formed on this mounting fitting member 20, and this male screw 20*b* is located on the opposite side of the cylindrical portion 20*a*. A flange portion 20*c* is provided on intermediate portions of these members. Furthermore, a hole having a bottom 20*d* is formed in the cylindrical portion 20*a* as a hole on the coaxial manner from the edge surface. This hole having the bottom 20*d* is formed in a two-stage shape, namely the hole portion on the opening side has the wide diameter, whereas the hole portion on the bottom side has the narrow diameter.

In addition, an insulating resin pipe 44 having flexibility is arranged in the coaxial manner in such a way that the helical coil 48 is embedded into this insulating resin pipe 44. This insulating resin pipe 44 is formed in such a manner that this resin pipe 44 is bridged from the fringe portion 20*c* of the mounting fitting member 20 to the side of the cylindrical portion 20*a*. This insulating resin pipe 44 is formed by way of insert molding. Concretely speaking, the helical coil 48 is firstly depressed by such a mold having an inner diameter equal to an outer diameter of the helical coil 48 and then, is fixed. Also, the mounting fitting member 20 is fixed by this mold at the same time. Furthermore, a central fitting member coaxially inserted into this helical coil 48 while an outer diameter of this central fitting member is made smaller than the inner diameter of the helical coil 48. One edge of this central fitting member is inserted into the hole portion of the hole 20*d* having the bottom of the mounting fitting member 20. This hole portion has the narrow diameter. The play edge of the helical coil 48 is properly closed by both a mold for depressing the outer diameter and a central mold. The insulating resin having flexibility is injected into a space defined by both these molds to solidify. This insulating resin is formed having a substantially tapered shape from the tight winding side of the helical coil 48 over the mounting fitting member 20. Also, in order to depress the outer diameter of the helical coil 48 on the tight winding side, a long ridge is formed in the mold along the axial direction. As indicated in FIG. 9(*b*) and FIG. 9(*c*), grooves 44*a* and 44*a* are formed in the insulating resin pipe 44. Moreover, as indicated in FIG. 9(*b*) and FIG. 9(*c*), a coupling reinforcement portion 44*b* is formed in such a way that the resin may cover the inner peripheral portion of the hold portion having the wide diameter of the hold 20*d* having the bottom of the mounting fitting member 20. This coupling reinforcement portion 44*b* is provided so as to prevent the insulating resin pipe 44 from being simply damaged. This pipe damage is caused by such a reason that the thickness of the insulating resin pipe 44 is rapidly reduced at the tip portion of the cylindrical portion 20*a* of the mounting fitting member 20. Thus, as shown in the sectional view of FIG. 9(*d*), the coupling reinforcement portion 44*b* is formed with being deformed.

A center rod 42 functioning as a center member made of an insulating resin and having flexibility is furthermore inserted inside the antenna element 10 formed with the above-described structure. Also, an antenna cover 22 made of an insulating resin and having flexibility is used to cover the outside thereof. Then, as shown FIG. 11, an antenna apparatus 46 is constituted. It should also be noted that the center rod 42 may be made of a center pipe.

Since the above-described antenna element 10 of the present invention is arranged in such a manner that the helical coil 48 is embedded inside the insulating resin pipe 44 by way of the insert molding, even when this antenna element 10 is repeatedly bent, there is no such a difficulty that the coil pitch is shifted. Moreover, since the resin to be processed by the insert resin is made in a pipe shape, even when the winding diameter of the helical coil 48 is large, for example, 6 mm, there is no risk that a "drop" is produced during the molding process, while the thickness of the insulating resin pipe 44 is properly set. Then, since the resin is made in the pipe shape, this pipe-shaped resin can have higher elastic characteristic than that of such a solid member. Furthermore, since the center rod 42 and the center pipe, which own proper elastic characteristics, are inserted into the insulating resin pipe 44, it is possible to easily manufacture such an antenna element 10 having a desirable rigid characteristic as well as a desirable elastic characteristic. Also, the coupling reinforcement portion 44*b* formed with the insulating resin pipe 44 in an integral body is arranged into the hole 20*d* having the bottom of the cylindrical portion 20*a* of the mounting fitting member 20 which is engaged with the helical coil 48. As a result, there is no risk that the thickness of the insulating resin pipe 44 is made very thin at the edge portion of this mounting fitting member 20. As a consequence, the present invention can avoid such a risk that since the thickness of the insulating resin pipe 44 is made very thin, this resin pipe is simply broken by the bending force. Moreover, in accordance with the manufacturing method, since the outer diameter of the helical coil 48 is depressed by the mold, there is no such a risk that the coil pitch is shifted during the insert molding. Moreover, since the outer diameter of the helical coil is depressed by the insert molding mold, the structure of this mold can be made simple, and also the helical coil can be firmly fixed.

Figure 12:
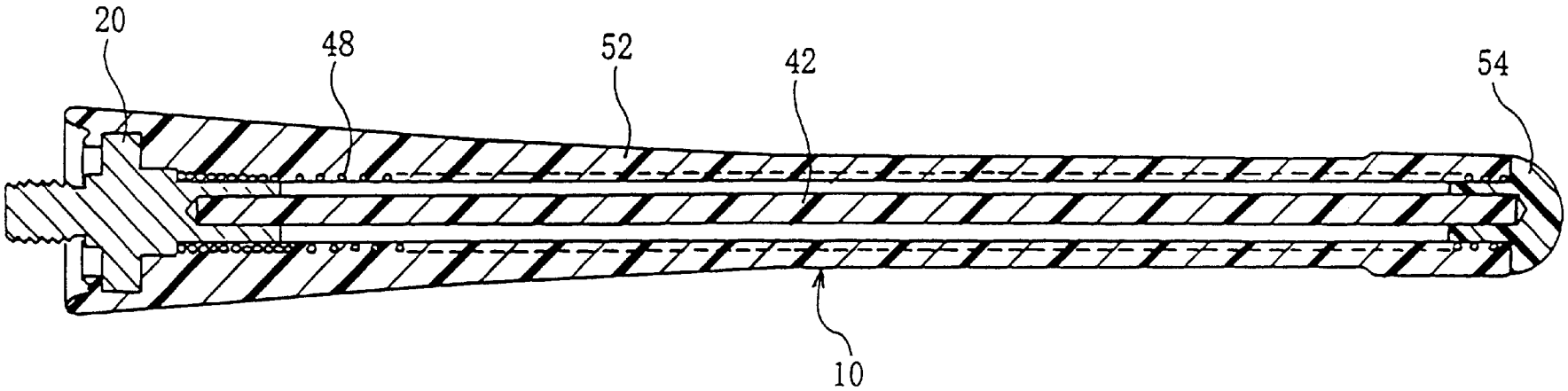
FIG. 12 is a sectional view for showing a structure of an antenna element according to a second embodiment of the present invention.

Furthermore, referring now to FIG. 12, a structure of an antenna element 10 according to a second embodiment of the present invention will be explained. In FIG. 12, a structure of a helical coil 48 and a structure of a mounting fitting member 20 are substantially same as those shown in FIG. 10. However, a hole 20*d* having a bottom of this mounting fitting member 20 is formed without changing a diameter thereof in a half way. Then, a center mold having an outer diameter equal to an inner diameter of the helical coil 48 is inserted into this helical coil 48, and while the helical coil 48 is depressed by this center mold, this helical coil 48 is fixed. Furthermore, a mold having an inner diameter larger than the outer diameter of the helical coil 48 is used to cover this helical coil 48. An insulating resin having flexibility is injected into a space formed both these molds to be fixed by the insert molding. The insulating resin is formed so as to also cover the flange portion 20*c* of the mounting fitting member 20. The insulating resin pipe 52 arranged in such a manner that the helical coil 48 is embedded into this insulating resin pipe 52 may function also as to antenna cover 22 shown in FIG. 11.

Either the center rod 42 or the center pipe functioning as the center member is inserted into the antenna element 10 having the above-described structure, and the play edge side of the helical coil 48 is closed by providing a cap 54 made of an insulating resin. Both ends of this center rod 42 are fixed by the hole 20*d* having the bottom of the mounting fitting member 20 and the cap 54.

In the embodiment shown in FIG. 12, since the insulating mold is injected into the space to be insert-molding and this space is formed by the center member inserted into the helical coil 48 and the mold covered with the helical coil 48, the structure of this mold can be made simple, and therefore, the antenna apparatus can be manufactured at a lower cost.

Figure 13:
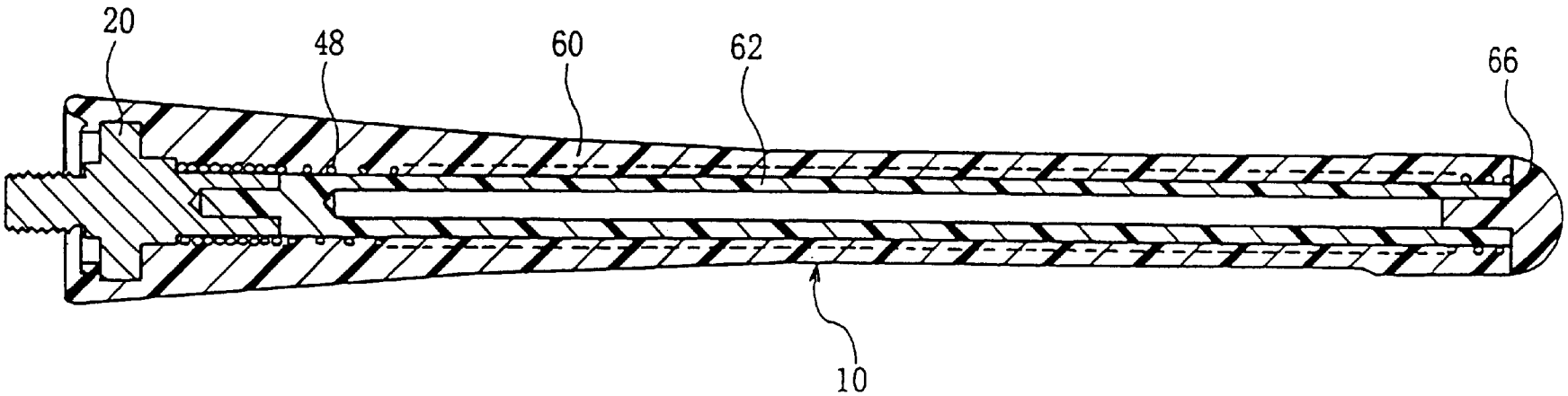
FIG. 13 is a sectional view for showing a structure of an antenna element according to a third embodiment of the present invention.

Furthermore, referring now to FIG. 13, a structure of an antenna element 10 according to a third embodiment of the present invention will be explained. In FIG. 13, a structure of a helical coil 48 and a structure of a mounting fitting member 20 are substantially same as those shown in FIG. 10. Then, a center pipe 62 functioning as a center member having an outer diameter equal to an inner diameter of the helical coil 48 is inserted into the helical coil 48, and thus, the helical coil 48 is depressed by this center pipe. This center pipe 62 is made of an insulating resin having flexibility, and one end of this center pipe 62 is inserted into the hole 20*d* having the bottom of the mounting fitting member 20 so as to be fixed. Furthermore, a mold having an inner diameter larger than the outer diameter of the helical coil 48 is used to cover this helical coil 48 similar to the second embodiment shown in FIG. 12. An insulating resin having flexibility is injected into a space formed by both this mold and the center pipe 62 to be fixed by the insert molding. The insulating resin pipe 60 formed in such a manner holds the helical coil 48 which is inserted into this insulating resin pipe, and also may function as the antenna cover 22 shown in FIG. 11. As a result, the antenna element 10 is arranged. It should be understood that the play edge side of the helical coil 48 is closed by a cap 66.

In the embodiment shown in FIG. 13, since the insulating resin is injected into the space to be insert-molding and this space is formed by the center member inserted into the helical coil 48 and the mold covered with the helical coil 48, the structure of this mold can be made simple, and therefore, the antenna apparatus can be manufactured in lower cost.

Figure 14:
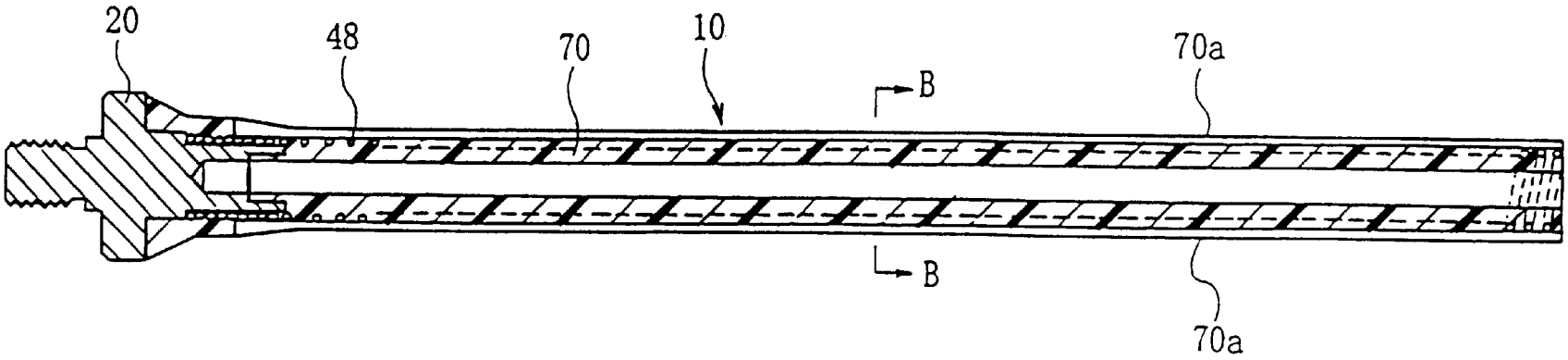
FIG. 14 illustrates a structure of an antenna element according to a fourth embodiment of the present invention.
Figure 14:
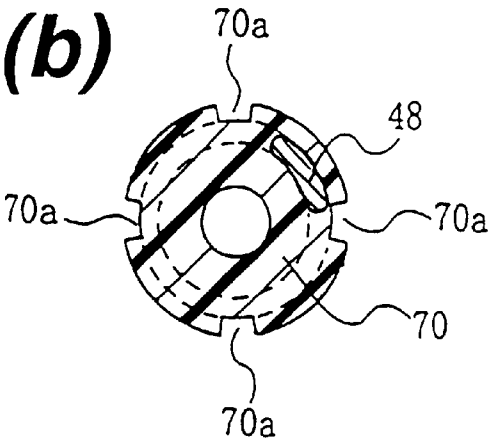

Then, with reference to FIG. 14, a structure of an antenna element 10 according to a fourth embodiment of the present invention will now be furthermore described. The antenna element 10 of the fourth embodiment shown in FIG. 14 owns the following different structure, as compared with that of the first embodiment. That is, the helical coil 48 is embedded into an intermediate portion of a thick portion of an insulating resin pipe 70 having flexibility. Also, both the outer diameter of the helical coil 48 and the inner diameter thereof are not located on the same plane with respect to both the outer diameter of the insulating resin pipe 70 and the inner diameter thereof. This is realized by that when the insulating resin pipe 70 is insert-molded, 3 or more ridges along the axial direction (4 ridges in the fourth embodiment) are formed on the inner peripheral portion of the mold to be covered on the helical coil 48. The outer diameter of the helical coil 48 is depressed by tip portions of these ridges. As a result, grooves 70*a*, 70*a*, 70*a*, as shown in FIG. 14(*b*) are recognized in the sectional plane of the insulating resin pipe 70.

It should be understood that since the ridge formed on the mold may merely depress the helical coil 48, the present invention is not limited to such a ridge formed along the axial direction, but also may cover a helical-shaped ridge having a different pitch from the pitch of the helical coil 48, and also another ridge capable of partially depressing the helical coil with respect to the axial direction. Also, while the inner diameter of the helical coil 48 is properly depressed by a ridge, the helical coil is insert-molded.

What is claimed is:

1. A method of manufacturing an antenna element comprising:

orienting a coiled conductor within a mold;

introducing a liquid mold material into the mold;

allowing the liquid mold material to solidify, the coiled conductor being at least partially embedded within the solidified mold material and forming an integral element with the mold material;

removing the coiled conductor and the mold material from the mold; and wherein the mold includes an inner mold portion and an outer mold portion, the step of orienting the coiled conductor within the mold including:

orienting the inner mold portion within an axially extending interior of the coiled conductor; and orienting the outer mold portion so that it surrounds at least a portion of the coiled conductor, wherein the liquid mold material is introduced into the mold so that it becomes disposed between the inner mold portion and the outer mold portion.

2. The method of claim 1, wherein the mold material is an insulating resin.

3. The method of claim 1, wherein the outer mold portion includes a plurality of ridges extending along an axial length of an interior of the outer mold portion, the step of orienting the outer mold portion including the step of engaging the ridges with an exterior of the coiled conductor.

4. The method of claim 1, wherein an inner diameter of the coiled conductor is greater than an outer diameter of the inner mold portion.

5. A method of manufacturing an antenna element comprising:

orienting a coiled conductor within a mold;

introducing a liquid mold material into the mold;

allowing the liquid mold material to solidify, the coiled conductor being at least partially embedded within the solidified mold material and forming an integral element with the mold material;

removing the coiled conductor and the mold material from the mold;

providing a mounting fitting member, the mounting fitting member having a substantially cylindrical portion; and engaging an end part of the coiled conductor with the substantially cylindrical portion, wherein said end part of the coiled conductor has a number of turns per unit length greater than a remainder of the coiled conductor.

6. The method of claim 5, wherein at least a part of an exterior surface and an interior surface of the substantially cylindrical portion of the mounting fitting member becomes surrounded by mold material during the step of introducing the liquid mold material into the mold.

7. The method of claim 6, wherein the interior surface of the substantially cylindrical portion includes a cylindrical interior wall and a sloped wall adjacent to the cylindrical interior wall, said end part of the coiled conductor being engaged with said exterior surface of the substantially cylindrical portion.

8. The method of claim 1, wherein an outer diameter of the inner mold portion is approximately equal to an inner diameter of the coiled conductor.

9. The method of claim 8, further comprising:

providing a mounting fitting member, the mounting fitting member having a substantially cylindrical portion; and engaging an end part of the coiled conductor with the substantially cylindrical portion, wherein at least a part of an exterior surface of the substantially cylindrical portion of the mounting fitting member becomes surrounded by mold material during the step of introducing the liquid mold material into the mold.

10. The method of claim 8, further comprising:

inserting a center rod into an axially extending interior of the integral mold material and coiled conductor, the center rod being spaced from an interior of the coiled conductor; and placing a cap over an end of the center rod and over an end of the mold material.

11. The method of claim 1, wherein an inner diameter of the mold outer portion is approximately equal to an outer diameter of the coiled conductor.

12. A method of claim 1, wherein an outer diameter of the inner mold portion is approximately equal to an inner diameter of the coiled conductor.

13. A method of manufacturing an antenna element comprising:

orienting a coiled conductor within a mold;

introducing a liquid mold material into the mold;

allowing the liquid mold material to solidify, the coiled conductor being at least partially embedded within the solidified mold material and forming an integral element with the mold material;

removing the coiled conductor and the mold material from the mold;

inserting a flexible center rod into an axially extending interior of the integral mold material and coiled conductor; and covering the mold material and the coiled conductor with an insulating cover.

14. A method of manufacturing an antenna element comprising:

orienting a coiled conductor within a mold;

introducing a liquid mold material into the mold;

allowing the liquid mold material to solidify, the coiled conductor being at least partially embedded within the solidified mold material and forming an integral element with the mold material;

removing the coiled conductor and the mold material from the mold; and inserting a center pipe into an interior of the coiled conductor prior to introducing the liquid mold material into the mold, the center pipe becoming integral with the mold material when the mold material is allowed to solidify.

15. A method of manufacturing an antenna element comprising:

orienting a coiled conductor within a mold;

introducing a liquid mold material into the mold;

allowing the liquid mold material to solidify, the coiled conductor being at least partially embedded within the solidified mold material and forming an integral element with the mold material;

removing the coiled conductor and the mold material from the mold; and wherein the integral mold material and coiled conductor are in the shape of a hollow cylinder.

16. An antenna element comprising:

a conductive mounting member having a substantially cylindrical portion;

a coiled conductor engaged at an end part with the substantially cylindrical portion of the mounting member;

a substantially cylindrical insulating structure, the coiled conductor being embedded within the insulating structure, wherein the insulating structure surrounds at least a portion of an outer peripheral surface of the substantially cylindrical portion of the mounting member; and wherein an inner surface of the coiled conductor is disposed around said outer peripheral surface of the substantially cylindrical portion.

17. The antenna element of claim 16, wherein the substantially cylindrical portion is a hollow cylinder, the insulating structure contacting a portion an inner peripheral surface of the hollow cylinder.

18. The antenna element of claim 16, wherein the insulating structure has a hollow substantially cylindrical shape.

19. The antenna element of claim 18, wherein an inner diameter of the insulating structure is less than an inner diameter of the coiled conductor.

20. The antenna element of claim 18, further comprising:

a center rod disposed within the hollow insulating structure, the center rod being spaced from the coiled conductor and engaging an interior of the insulating structure; and a cover disposed on an exterior of the insulating structure.

21. The antenna element of claim 18, further comprising a rod disposed within an interior of the hollow insulating structure, wherein an inner diameter of the insulating structure is approximately equal to an inner diameter of the coiled conductor, and the rod is spaced from the interior of the coiled conductor.

22. The antenna element of claim 18, further comprising a hollow rod disposed within an interior of the hollow insulating structure, wherein an inner diameter of the insulating structure is approximately equal to an inner diameter of the coiled conductor, and the rod is adjacent to the inner diameter of the insulating structure.

23. The antenna element of claim 16, wherein the insulating structure includes grooves extending axially along an exterior of the insulating structure.

24. An antenna element comprising:

a conductive mounting member;

a coiled conductor engaged at an end part with the mounting member;

a substantially cylindrical insulating structure, the coiled conductor being embedded within the insulating structure, wherein the insulating structure is a unitary molded structure, the coiled conductor being integrally formed with the insulating structure, wherein the conductive mounting member includes a substantially cylindrical portion, the insulating structure being integrally molded about a portion of the substantially cylindrical portion; and wherein an outer diameter of the coiled conductor is approximately equal to an outer diameter of the insulating structure.

25. An antenna element comprising:

a conductive mounting member;

a coiled conductor engaged at an end part with the mounting member;

a substantially cylindrical insulating structure, the coiled conductor being embedded within the insulating structure, wherein the insulating structure is a unitary molded structure, the coiled conductor being integrally formed with the insulating structure, wherein the conductive mounting member includes a substantially cylindrical portion, the insulating structure being integrally molded about a portion of the substantially cylindrical portion; and wherein an inner diameter of the coiled conductor is approximately equal to an inner diameter of the insulating structure.

* * * * *